United States Patent [19]

Takeuchi et al.

[11] Patent Number: 5,014,047

[45] Date of Patent: May 7, 1991

[54] DISPLAY ELEMENT, DISPLAY METHOD AND APPARATUS USING SAID ELEMENT

[75] Inventors: Hirosato Takeuchi; Yasuo Kazama, both of Tokyo, Japan

[73] Assignee: Nitto Kohki Co., Ltd., Tokyo, Japan

[21] Appl. No.: 355,412

[22] Filed: May 23, 1989

[30] Foreign Application Priority Data

May 31, 1988 [JP] Japan ..... 63-134185

[51] Int. Cl.[5] ..... G09G 3/34

[52] U.S. Cl. ..... 340/763; 340/764; 340/788

[58] Field of Search ..... 340/763, 786, 787, 788, 340/764, 765, 783, 815.07, 815.24, 815.27, 815.29

[56] References Cited

U.S. PATENT DOCUMENTS 3,698,793 10/1972 Tellerman ..... 340/783
3,812,490 5/1974 Goodrich ..... 340/788
3,924,228 12/1975 Goodrich ..... 340/763
4,694,289 9/1987 Kent ..... 340/783
4,831,372 5/1989 Riddoch ..... 340/783

FOREIGN PATENT DOCUMENTS 2133121 1/1973 Fed. Rep. of Germany .
405992 7/1966 Switzerland .

*Primary Examiner*—Alvin E. Oberley
*Assistant Examiner*—Eric Frahm
*Attorney, Agent, or Firm*—Nixon & Vanderhye

[57] ABSTRACT

A display element comprising a casing having a window, a transparent member for closing the window, at least one flat display member having a face which is colored by three primary colors or other single color, a flat light absorbent shield member sandwiched between the transparent member and the flat display member, containing light absorbent liquid therein and serving to urge the light absorbent liquid toward the outer rim portion thereof when it is pressed, but to return to its original state to shield the face when no pressure is applied to it, and a pressure element capable of pressing the flat light absorbent shield member at each face.

9 Claims, 5 Drawing Sheets

DISPLAY ELEMENT, DISPLAY METHOD AND APPARATUS USING SAID ELEMENT'

BACKGROUND OF THE INVENTION

1. Field of the Invention

The present invention relates to a display element capable of being clearly distinguished even in the sunlight and easily and quickly controlled by a small amount of current to provide various kinds of displays. The present invention also relates to display method and apparatus which use the display elements.

2. Description of the Related Art

Display means or apparatuses commonly seen in leading our lives are numerous, including small-sized ones such as the display panel in computers and large-sized ones such as the scoreboard in athletics and baseball stadiums.

The conventional display means which belong to the so-called lightening board such as the scoreboard in athletics and baseball stadiums are intended to make single colored or multi-colored displays by switching on and off electric bulbs arranged in a matrix.

These conventional display means are often used in the shining of the sun. When the sun light is brighter than the luminous energy of those light sources which form a display screen, however, the display screen becomes so white as not to be clearly distinguished.

Further, the conventional display means use light sources to provide various kinds of displays. Particularly when color displays are intended, therefore, current consumption becomes large to make the intended colors clear.

Furthermore, when some of those light sources which form the display screen are broken, it is quite troublesome in the conventional display means to exchange them with new ones. In addition, complicated wiring is needed because the display screen is formed by light sources. This makes the cost high.

SUMMARY OF THE INVENTION

An object of the present invention is therefore to provide a display element, a display method and a display apparatus for making a display to be clearly distinguished even in the sunlight and controlled easily and quickly to make various kinds of displays by a small amount of current consumed.

The above-mentioned drawbacks can be solved by a display element of the present invention comprising a window closed by a transparent member, a pressure element, a flat display member having a face which is colored by one of the three primary colors or other single color, and a flat light absorbent shield member sandwiched between the transparent member and the flat display member, containing light absorbent liquid therein and serving to urge the light absorbent liquid toward the outer rim portion thereof when it is pushed or pressed by the pressure element, but to return to its original state when no pressure is applied to it, so as to make the colored face of the flat display member visible or invisible from outside, wherein the pressure element, display member and light absorbent shield member are piled one upon the other in this order relative to the window closed by the transparent member.

The above-mentioned drawbacks can also be solved by a display method of the present invention comprising a step of making the colored face of the flat display member visible by pushing or pressing the flat light absorbent shield member, a step of leaving the whole of the light absorbent liquid stayed all over the colored face of the flat display member to completely shield it by not pushing or pressing the flat light absorbent shield member, or a step of leaving a part of the light absorbent liquid on the colored face of the flat display member to half-shield it, so as to display letters, figures and symbols.

A display apparatus of the present invention comprises the display elements arranged in a matrix and a means for selectively driving the pressure elements for the display elements.

When the pressure element is made operative to push or press a part or the whole of the flat display member in the case of the display element having the arrangement as described above, the flat light absorbent shield member is pushed or pressed by the flat display member, which is behind the flat light absorbent shield member, to make the display member visible from outside. More specifically, the underside of the flat light absorbent shield member is pushed against the upper side thereof by the flat display member and the light absorbent liquid sealed in the flat light absorbent shield member is pushed away to the outer rim portion of the flat light absorbent shield member to make the colored face of the flat display member visible from outside to thereby display a color. When the pressure element is left inoperative, the light absorbent liquid in the flat light absorbent shield member returns to its original state to shield the flat display member or erase the color displayed because no pressure is applied to the flat light absorbent shield member.

In the case of the display apparatus in which the display elements are arranged in a matrix, the light absorbent liquid in the flat light absorbent shield member is pushed away from on the colored face of the flat display member or wholly or partly stayed thereon by adjusting the pushing force of the pressure element applied to the flat display member. The colored faces of the flat display members can be thus made visible or partly or completely shielded by the flat light absorbent shield members, so that colors can be made visible to provide various kinds of displays.

When color displays are to be intended, the three primary colors of red, green and blue on each of the colored faces of the flat display members are made visible by selectively pushing them by the pressure elements. Colors thus made visible on every unit of the flat display members are combined with one another to create color displays.

Although the conventional lightening board became so white as not to be clearly distinguished when the sunlight shot it, the display element of the present invention can be made clear by the sunlight to enhance its display effect. Particularly, the colored face of the flat display member is made visible when the flat display member is pushed by the pressure element and the colored faces thus made visible can be clearly distinguished from those shielded in the shining of the sunlight. This is quite effective as a display element. In addition, the display element can be easily and quickly controlled to provide various kinds of displays and current consumed to control the display element is quite small in amount.

Further, the display method of the present invention can display figures, letters, symbols and the like by pushing away the light absorbent liquid in the flat light absorbent shield member from on the colored face of the flat display member to make the colored face visible from outside. Or the light absorbent liquid is wholly or partly stayed on the colored face of the flat display member to completely or partly shield the colored face. The letters, figures and symbols can be contoured by black or dark black to clearly distinguish them and this is quite effective in attracting attention.

Furthermore, the display apparatus of the present invention comprises display elements arranged in a matrix and a means for selectively driving pressure elements for the display elements, each of said display elements including a window closed by a transparent member, a pressure element a flat display member having a face which is colored by one of the three primary colors or other single color, and a flat light absorbent shield member sandwiched between the transparent member and the flat display member, containing light absorbent liquid therein and serving to urge the light absorbent liquid toward the outer rim portion thereof when it is pushed or pressed by the pressure element but to return to its original state when no pressure is applied to it, so as to make the colored face visible or invisible from outside, wherein the pressure element, flat display member and flat light absorbent shield member are piled one upon the others in this order relative to the window closed by the transparent member. According to the display apparatus, therefore, the colored faces of the flat display members are made visible by selectively pushing the flat display members by means of the pressure elements. The colored faces thus made visible do not become so white, as often seen in the case where display effect is attained by switching on and off electric bulbs, even in the shining of the stronger sunlight in the daytime, but they can be made clearer by the sunlight. When artificial light is added to make them a little brighter particularly at night, they can be distinguished clearly enough. When piezo-electric elements are used, a slight volume of voltage is enough to quickly and easily control the display created by the display elements.

DETAILED DESCRIPTION OF THE PREFERRED EMBODIMENTS

Figure 1:
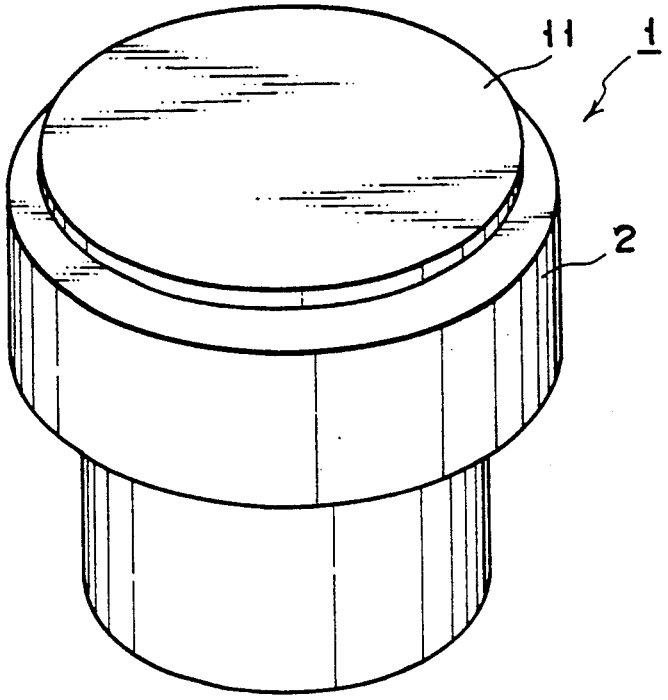
FIG. 1 is a perspective view showing the whole of an example of the display element according to the present invention.
Figure 2:
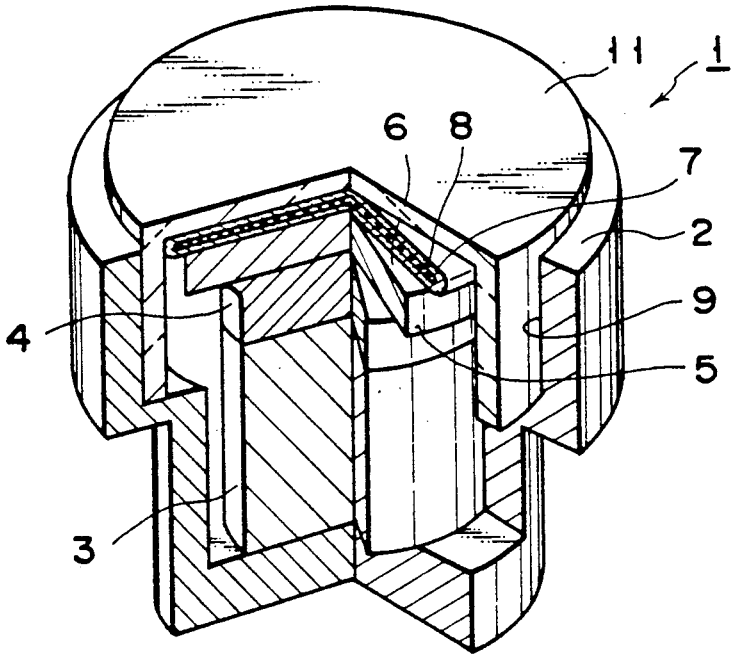
FIG. 2 is a perspective view showing the display element partly sectioned.

FIGS. 1 through 4 show an example of the display element according to the present invention. They also show how the display element is made operative to make various kinds of displays intended.

Display element 1 includes column-like casing 2, which has window 9 at the front side thereof, and this window 9 is closed by transparent member 11. Piezo-electric element 3 which serves as a pressure means is housed in casing 2. Piezo-electric element 3 can also be regarded as a piezo-electric actuator, which is a well-known transducer for changing electric energy to mechanical one such as stress and displacement, and when predetermined voltage is applied to piezo-electric element 3, it is displaced by a certain volume. This piezo-electric element 3 in the present invention serves to push or press flat display member 5 at the backside thereof. When piezo-electric element 3 is formed by bonding a plurality of piezo-electric plates one upon the others like a stack, its response speed as well as its energy changing efficiency can be made high. Pedestal 4 is fixed on the front side (or top in FIG. 3) of piezo-electric element 3. Flat display member 5 is fixed on this pedestal 4. The upper surface of flat display member 5 is appropriately colored to form colored face 6. Flat light absorbent and shield member 7 is fixed on the top of colored face 6. Flat shield member 7 is a soft transparent pouch in which light absorbent liquid 8 is contained. Dark black liquid suitable for absorbing light is used as light absorbent liquid 8 sealed in flat shield member 7 and when it is not pressurized, it functions to shield light. Therefore, light absorbent liquid 8 is sealed so enough in flat shield member 7 as to completely shield light reflected by colored face 6 of flat display member 5, which it is not pressurized. The front side of flat shield member 7 is opposed to transparent member 11 which closes window 9 of casing 2, and transparent member 11 is a no-colored lens or disk made of weather-proof hard plastics, glass or other transparent materials. Transparent member 11 is fixed to casing 2 to close window 9 to prevent rain drops or the like from entering into casing 2 through window 9.

Figure 3:
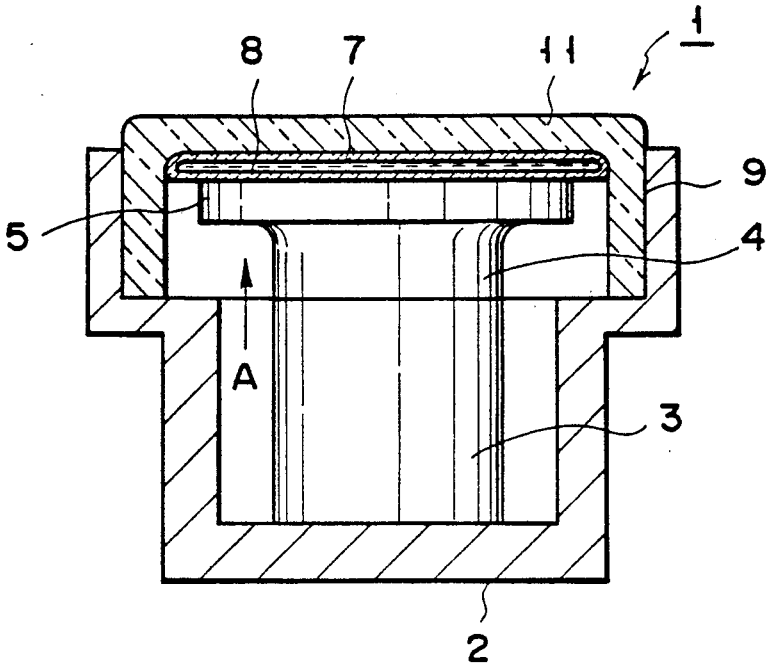
FIGS. 3 and 4 views showing how the display element shown in FIG. 1 operates.

When predetermined voltage is applied to piezo-electric element 3 which is under such a state as shown in FIG. 3, this piezo-electric element 3 is extended by a certain distance. When piezo-electric element 3 is extended in this manner, flat display member 5 is lifted through pedestal 4 fixed to piezo-electric element 3, thereby causing flat shield member 7 to be pushed or pressed. Flat shield member 7 is flexible and when it is pressed like this, therefore, its underside is pushed against its front side, so that light absorbent liquid 8 sealed in it can be forced to its outer circumference. Flat shield member 7 thus loses its light shield faculty because light absorbent liquid 8 is pushed away to the outer circumference of flat shield member 11. Light reflected by colored face 6 of flat display member 5 can pass through transparent member 11 which close window 9 at the front side of flat shield member 7. Colored face 6 of flat display member 5 can be thus viewed from outside.

Figure 4:
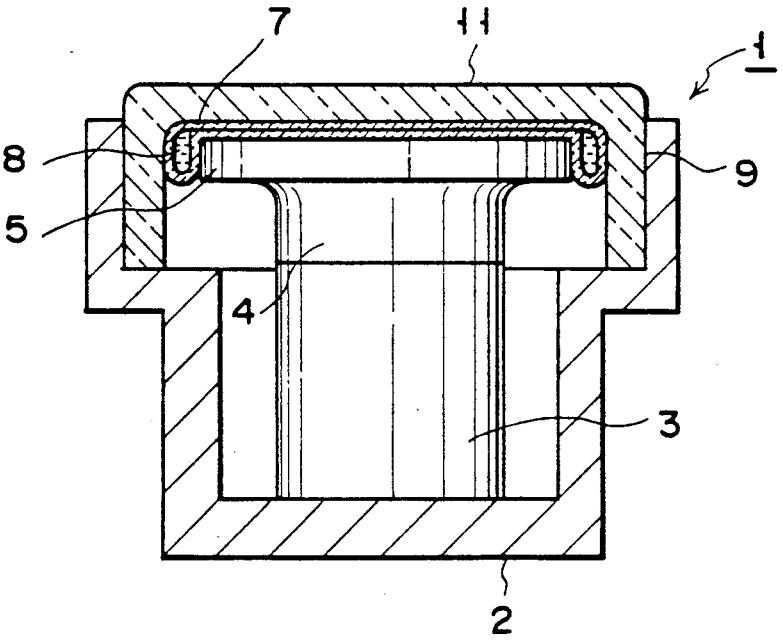

When voltage supply to piezo-electric element 3 which is under such a state as shown in FIG. 4 is stopped, piezo-electric element 3 returns to its original state. When it returns to its original state as shown in FIG. 3, flat display member 5 is lowered through pedestal 4 and flat shield member 7 returns to its original state due to its flexibility. Light absorbent liquid 8 which has been pushed away and stayed along the outer circumference of flat shield member 7 returns to the center portion of flat shield member 7 as this flat shield member 7 comes to take its shape like a pouch. Colored face 6 is thus again covered by light absorbent liquid 8, thereby making it impossible for colored face 6 to be viewed from outside.

Voltage applied to piezo-electric element 3 can be freely controlled to adjust the extending of piezo-electric element 3. Pressure applied to flat shield member 7 can be thus changed to gain neutral tints which are created by mixing the color of colored face 6 and that of light absorbent liquid 8.

According to the above-described display element of the present invention, color can be displayed by letting colored face 6 of flat display member 5 be viewed from outside, or shielding or half-shielding it. As sun or artificial light striking against the front side of display element 1 becomes brighter and brighter, therefore, colored face 6 of flat display member 5 can be viewed more and more brilliantly, and it can be clearly viewed in the distance even at night.

When this piezo-electric element 3 is used, the definition of colored face 6 of flat display member 5 can be freely controlled by a slight volume of voltage applied. This enables various kinds of displays, excellent in response, to be easily realized.

FIGS. 5 through 10 show examples of the display method and apparatus according to the present invention.

Figure 5:
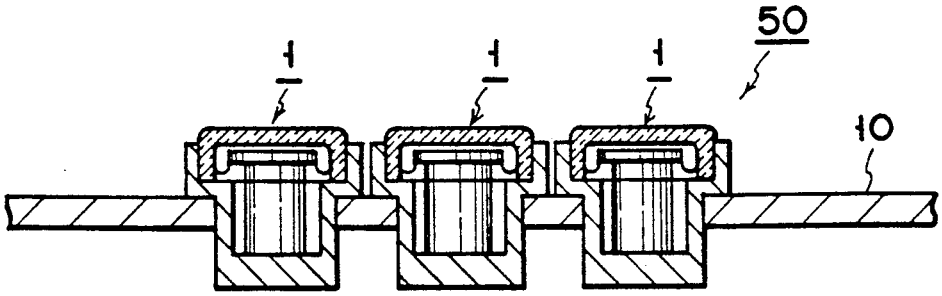
FIG. 5 is a sectional view showing an example of the display apparatus according to the present invention.
Figure 6:
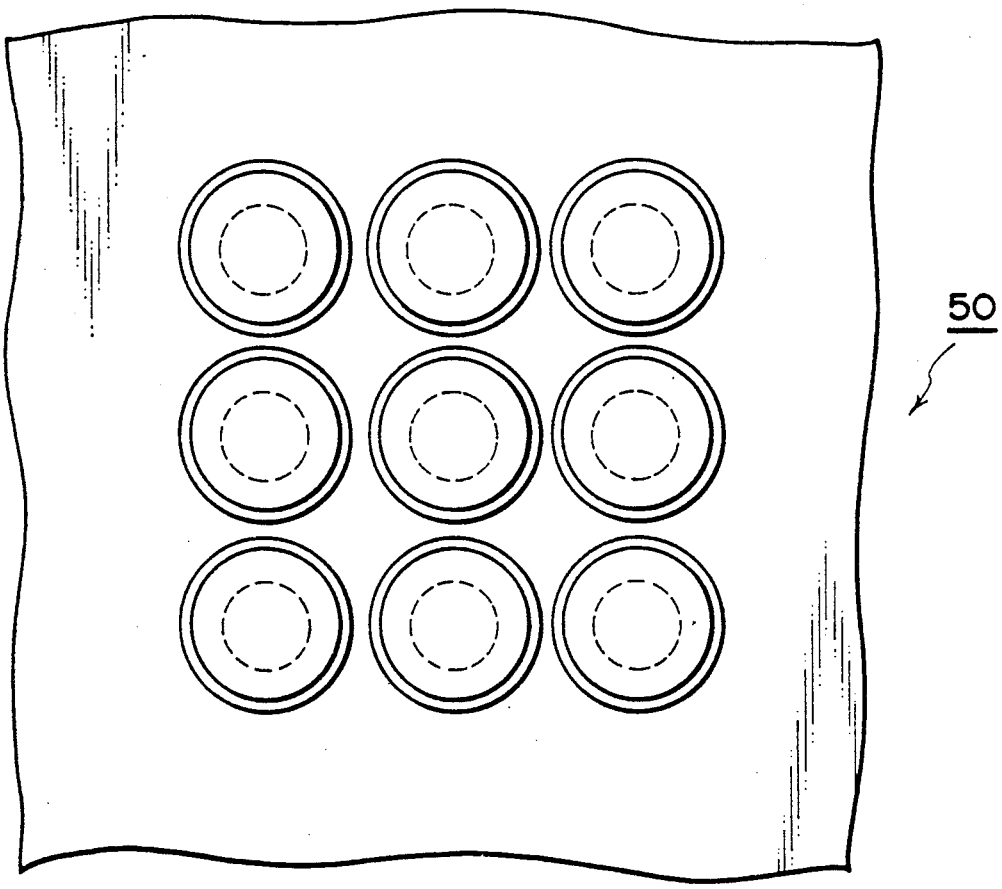
FIG. 6 is a front view showing a part of the display apparatus.

FIGS. 5 and 6 show display apparatus 50 provided with display elements 1 which have been described in FIGS. 1 through 4.

Figure 7:
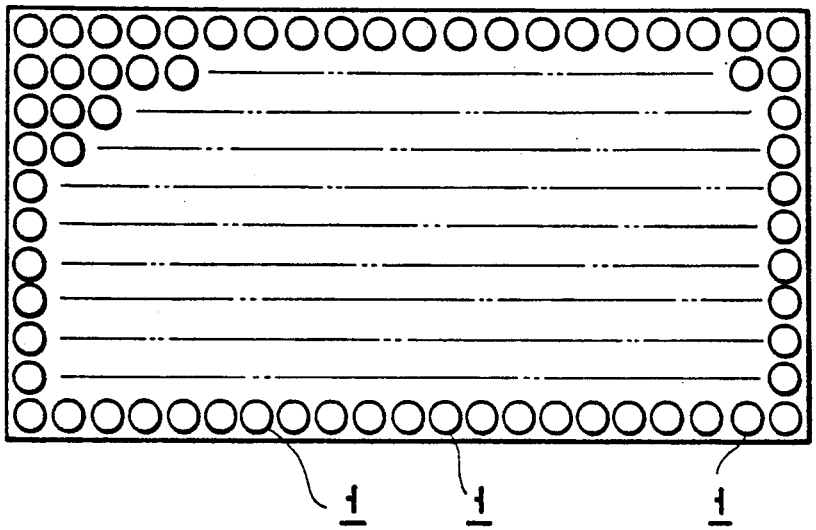
FIG. 7 is a front view showing display elements arranged like a matrix.
Figure 8:
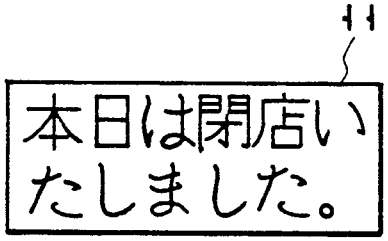
FIGS. 8, 9 and 10 show letters and figures displayed by the display apparatus of the present invention.
Figure 9:
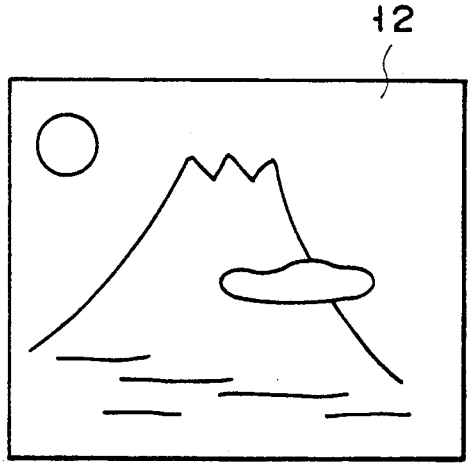
Figure 10:
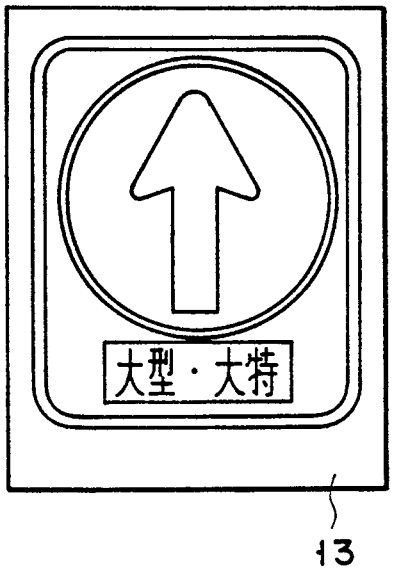

Display apparatus 50 comprises display elements 1 arranged in a matrix as shown in FIG. 7, each of display elements 1 having such arrangement as shown in FIG. 3. When colored faces 6 of display elements 1 have a single color, display apparatus 50 presents a simple one-colored display as shown by numeral 11 in FIG. 8. When three kinds of the flat display members whose faces 6 are colored red green and blue are used as a unit and controlled to make their colored faces 6 visible from outside, various kinds of color displays can be attained. FIG. 9 shows landscape painting display 12 and FIG. 10 shows a combination of figures and letters. These displays can be easily realized using the above-described display elements.

Figure 11:
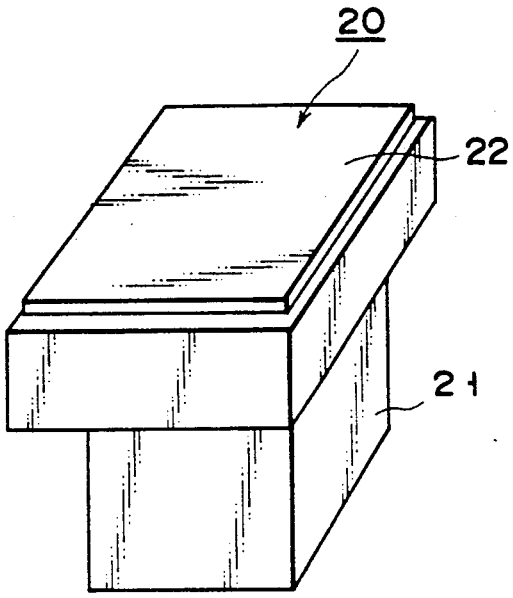
FIG. 11 is a perspective view showing the whole of another example of the display element according to the present invention.

FIG. 11 shows another example of the display element according to the present invention.

Display element 20 shown in FIG. 11 is different from the one 1 shown in FIG. 1 in that the former is formed not circular but rectangular when viewed from the front side thereof. What display element 20 is formed rectangular means that at least the flat display member, flat light absorbent shield member, window, and transparent member for closing the window as well as the casing are made rectangular.

According to this rectangular display element, therefore, no clearance is caused between the display elements when they are assembled in a matrix. This enables a display apparatus having a higher density to be produced.

Figure 12:
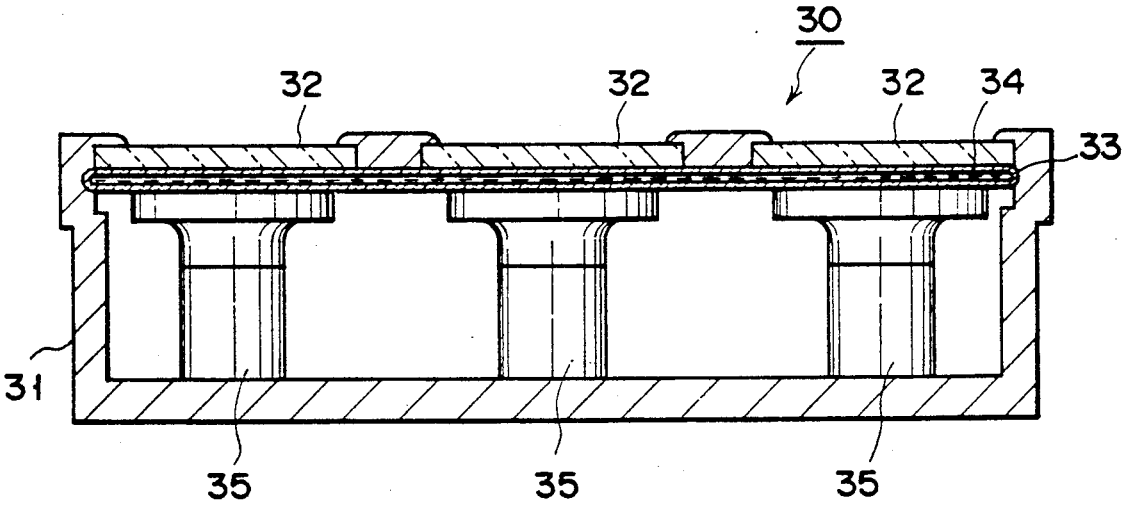
FIG. 12 is a sectional view showing a third example of the display element according to the present invention.

FIG. 12 shows a further example of the display element according to the present invention.

Each of display elements 1 shown in FIG. 1 has flat light absorbent shield member 7, but plural display elements 30 shown in FIG. 12 are assembled as a block using flat light absorbent shield member 33, in which light absorbent liquid 34 is sealed, common to the display elements 30 in this block.

According to the display element shown in FIG. 12, therefore, a display apparatus can be produced by assembling the display elements in blocks with one another. This makes it easier to produce and maintain the display apparatus.

Although the piezo-electric element has been used as the pushing or pressing element, the flat display member may be pushed or pressed by oil or air pressure instead. Further, when the colored face of the flat display member is coated by fluorescent paint or pigment, it can be made more remarkably visible at night.

What is claimed is:

1. A display element comprising:

a casing having a window;

a transparent member for closing the window;

a flat display member having a face with a single color or three primary colors;

a flat light absorbent shield member comprising a pouch having light absorbent liquid contained therein, said pouch sandwiched between said transparent member and said flat display member such that said flat display member is shielded in a normal state, at least one pressure element adapted, upon extension, to push said flat display member toward said transparent member to thereby press said flat light absorbent shield member against said transparent member and to force said move light absorbent liquid toward peripheral portions of said pouch so that light reflected by said flat display member can pass through said transparent member, and to restore said light absorbent liquid to said normal state upon retraction of said at least one pressure element.

2. The display element according to claim 1, wherein said face is coated with fluorescent paint.

3. The display element according to claim 1 wherein said pressure element is a piezo-electric element.

4. The display element according to claim 1, wherein said face of said flat display member has a circular shape.

5. The display element according to claim 4, wherein said pouch and said window have circular shapes with diameters larger than a diameter of said face of said flat display member.

6. A display apparatus having at least one display unit including a plurality of display elements each comprising:

a casing having a window;

a transparent member for closing the window;

a flat display member comprising a face with a single color or three primary colors;

a flat light absorbent shield member comprising a pouch having light absorbent liquid contained therein, said pouch sandwiched between said transparent member and said flat display member such that said flat display member is shielded in a normal state;

at least one pressure element adapted, upon extension, to push said flat display member toward said transparent member to thereby press said flat light absorbent shield member against said transparent member and to force said light absorbent liquid toward peripheral portions of said pouch so that light reflected by said flat display member can pass through said transparent member, and to restore said light absorbent liquid to said normal state upon retraction of said at least one pressure element.

7. A method of displaying letters, figures, and symbols, on a window closed by a transparent member, by using a display element constituted by stacking a pressure element, a flat display member having a face colored by a single color or three primary colors, and a flat light absorbent member having a pouch and a light absorbent liquid contained therein, inserted between the transparent member and the flat display member such that said flat display member is shielded in a normal state, comprising steps of:

(a) moving the face of the flat display member toward the window to thereby cause said light absorbent liquid to move toward peripheral portions of said pouch so that light reflected by said flat display member can pass through said transparent member; and (b) moving said face of the flat display member away from said window to thereby restore said light absorbent material to said normal state, shielding said flat display member.

8. The method of claim 7 wherein step (a) is carried out so that said light absorbent liquid continues to partially shield said flat display member.

9. A display apparatus comprising:

a plurality of display elements each including a casing having a window, a transparent member closing the window, a flat display member having a face with a single color or three primary colors, a light absorbent shield member having a pouch and light absorbent liquid contained therein, inserted between said transparent member and said flat display member; and a pressure element for pressing said flat display member and said light absorbent shield member toward said transparent member; and a pressure element activation means for selectively activating each of said pressure elements to move said pressure elements toward and away from associated ones of said flat display members.

* * * * *